US008083541B2

(12) United States Patent
Yeh

(10) Patent No.: US 8,083,541 B2
(45) Date of Patent: Dec. 27, 2011

(54) FLAT CABLE CONNECTION WIRE ASSEMBLY APPLICABLE FOR SIGNAL TRANSMISSION INTERFACE

(75) Inventor: Shih-Kun Yeh, Taoyuan Hsieh (TW)

(73) Assignee: Tennrich International Corp., Taoyuan Hsieh (TW)

( * ) Notice: Subject to any disclaimer, the term of this patent is extended or adjusted under 35 U.S.C. 154(b) by 275 days.

(21) Appl. No.: 12/482,130

(22) Filed: Jun. 10, 2009

(65) Prior Publication Data

US 2010/0087087 A1 Apr. 8, 2010

(30) Foreign Application Priority Data

Oct. 2, 2008 (TW) ..... 97217655 U

(51) Int. Cl.
*H01R 12/24* (2006.01)

(52) U.S. Cl. ..... 439/492; 439/497

(58) Field of Classification Search ..... 439/492, 439/495, 497–499
See application file for complete search history.

(56) References Cited

U.S. PATENT DOCUMENTS

| | | | | |
|---|---|---|---|---|
| 6,705,893 | B1 * | 3/2004 | Ko | 439/607.56 |
| 7,189,105 | B2 * | 3/2007 | Takaku et al. | 439/497 |
| 7,223,120 | B2 * | 5/2007 | Ko | 439/492 |
| 7,275,955 | B2 * | 10/2007 | Ko | 439/498 |

* cited by examiner

*Primary Examiner* — Xuong Chung Trans
(74) *Attorney, Agent, or Firm* — Jackson IPG PLLC; Demian K. Jackson

(57) ABSTRACT

The present invention discloses a flat cable connection wire assembly including a flexible flat cable and a connector, and the flexible flat cable includes a plurality of core wires, and the connector includes a plastic body and a plurality of terminals for an electric connection. The plastic body includes a plurality of slots arranged with a specific interval apart from one another and disposed at an end of the flexible flat cable for positioning each terminal, such that a specific interval is formed between terminals and provided for soldering each core wire with each terminal in the slot, while coupling with the connector. The invention provides a more secured and reliable structure of the flat cable connection wire assembly.

20 Claims, 6 Drawing Sheets

FLAT CABLE CONNECTION WIRE ASSEMBLY APPLICABLE FOR SIGNAL TRANSMISSION INTERFACE

BACKGROUND OF THE INVENTION (a) Field of the Invention

The present invention relates to a connection wire assembly applicable for a signal transmission interface, in particular to a stable and reliable flat cable connection wire assembly.

(b) Description of the Related Art

Flat cable is a common part used in electronic industry for connecting circuit boards. For example, a notebook computer adopts a flexible printed circuit board (FPCB) as a connection wire assembly for transmitting signals between an LCD screen and a main system of a notebook computer. In addition, there is another micro coaxial cable assembly which comes with high-precision of impedance and high flexibility to give a cutting edge and meet the fast changing notebook computer market. Since notebook computers gradually replace desktop computers and tend to have a thin design, the flat cable with core wires satisfies the manufacturing requirement of notebook computers and has a tendency of replacing the flexible printed circuit board (FPC).

Related flat cables generally have a structure as shown in FIG. 1, and a flexible flat cable (FFC) 10 composed of a specific quantity of core wires includes a rubber envelop 12 disposed at upper and lower positions of all core wires 11 for fixing the core wires 11. When the FFC is used, a connector 20 is connected to an end of the FFC 10 to form a flat cable connection wire assembly to facilitate an electric connection with a transmission port 31 of a main board.

With reference to FIG. 2 for a connector 20 of a conventional flat cable connection wire assembly, the connector 20 includes a plastic body 21 for arranging and separating each core wire 11, and a metal casing 22 disposed individually at upper and lower ends of the plastic body 21 for engaging the upper and lower ends with one another, and the flexible flat cable 10 and the connector 20 are coupled by the assembling and pressing effect of the two metal casings 22. However, such design has insufficient combining strength, and thus the flexible flat cable 10 may be separated from the connector 20 easily when the flat cable connection wire assembly is plugged into or unplugged from the transmission port.

SUMMARY OF THE INVENTION

Therefore, it is a primary objective of the present invention to provide a flat cable connection wire assembly applicable for a signal transmission interface with a secured and reliable structure to overcome the shortcomings of the prior art.

To achieve the foregoing objectives, the present invention provides a flat cable connection wire assembly applicable for a signal transmission interface, and the flat cable connection wire assembly comprises a flexible flat cable (FFC) and at least one connector installed at an end of the flexible flat cable, wherein the flexible flat cable includes a plurality of core wires, and the connector includes a plastic body for separating and arranging all core wires, a plurality of terminals provided for an electric connection, and at least one metal casing for supporting the flexible flat cable. More particularly, the plastic body has an open section disposed at an end corresponding to the flexible flat cable and provided for inserting and exposing each terminal, and a plurality of slots disposed at the open section for positioning each terminal, and there is a specific interval between the slots, so that a specific interval is formed between the terminals. Each core wire is soldered to fix the terminals into the slots respectively and also connecting the connector, so as to produce a flat cable connection wire assembly with a more secured and reliable structure.

Specifically, the present invention has the following advantages and effects:

1. Solder overfill will not occur easily in the manufacturing process.
2. There is no short circuit issue.
3. The invention provides a better signal transmission than the conventional single-point contact to enhance the overall quality and reliability of the connection wire assembly effectively.
4. The invention provides an excellent overall mechanical strength.
5. The invention achieves the effects of simplifying the structure of the connector significantly, reducing the overall height and saving space.

DETAILED DESCRIPTION OF THE PREFERRED EMBODIMENTS

The present invention will now be described in more detail hereinafter with reference to the accompanying drawings that show various embodiments of the invention as follows.

Figure 1:
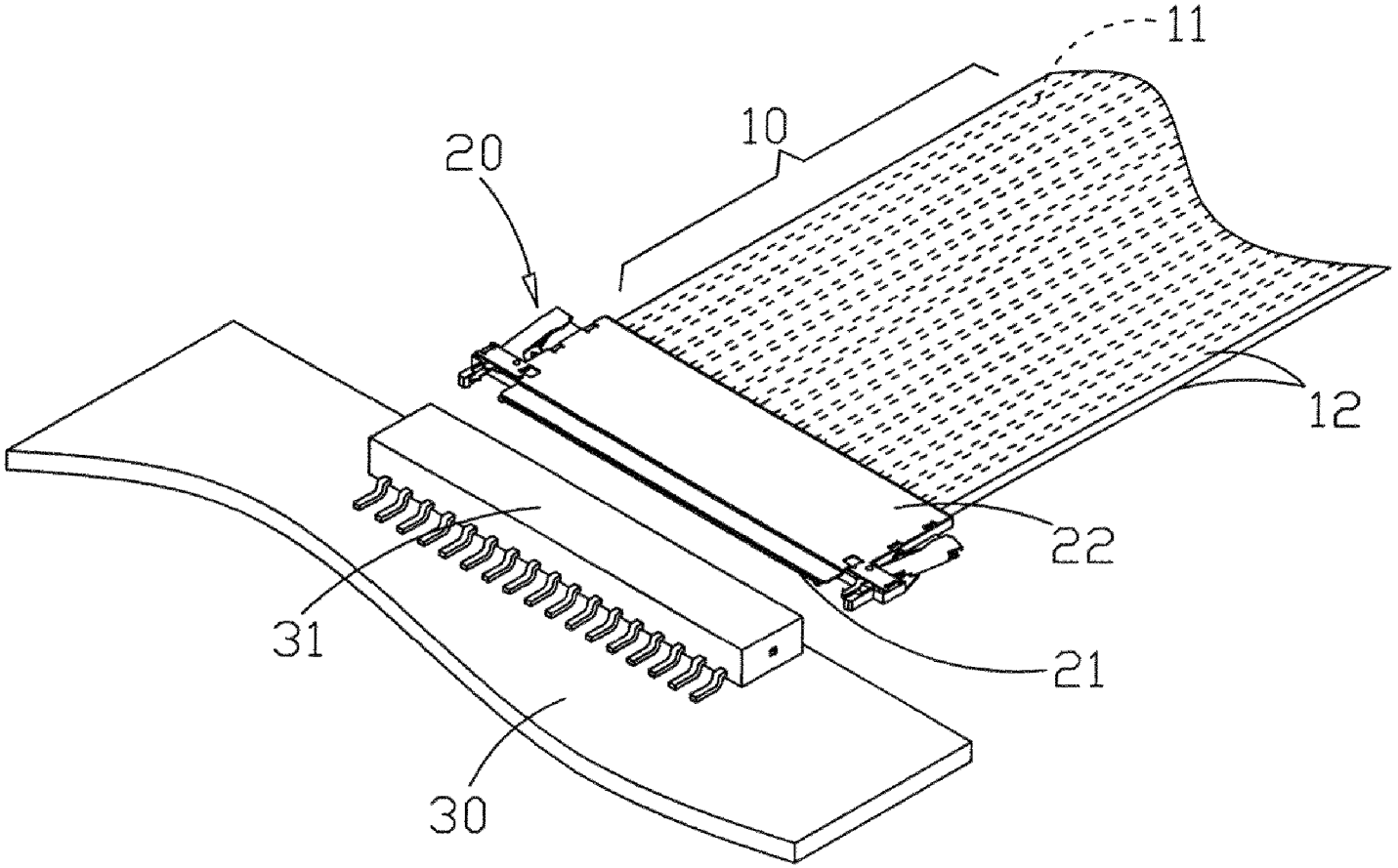
FIG.1 PRIOR ART
FIG. 1 is a perspective view of a conventional flat cable connection wire assembly.
Figure 2:
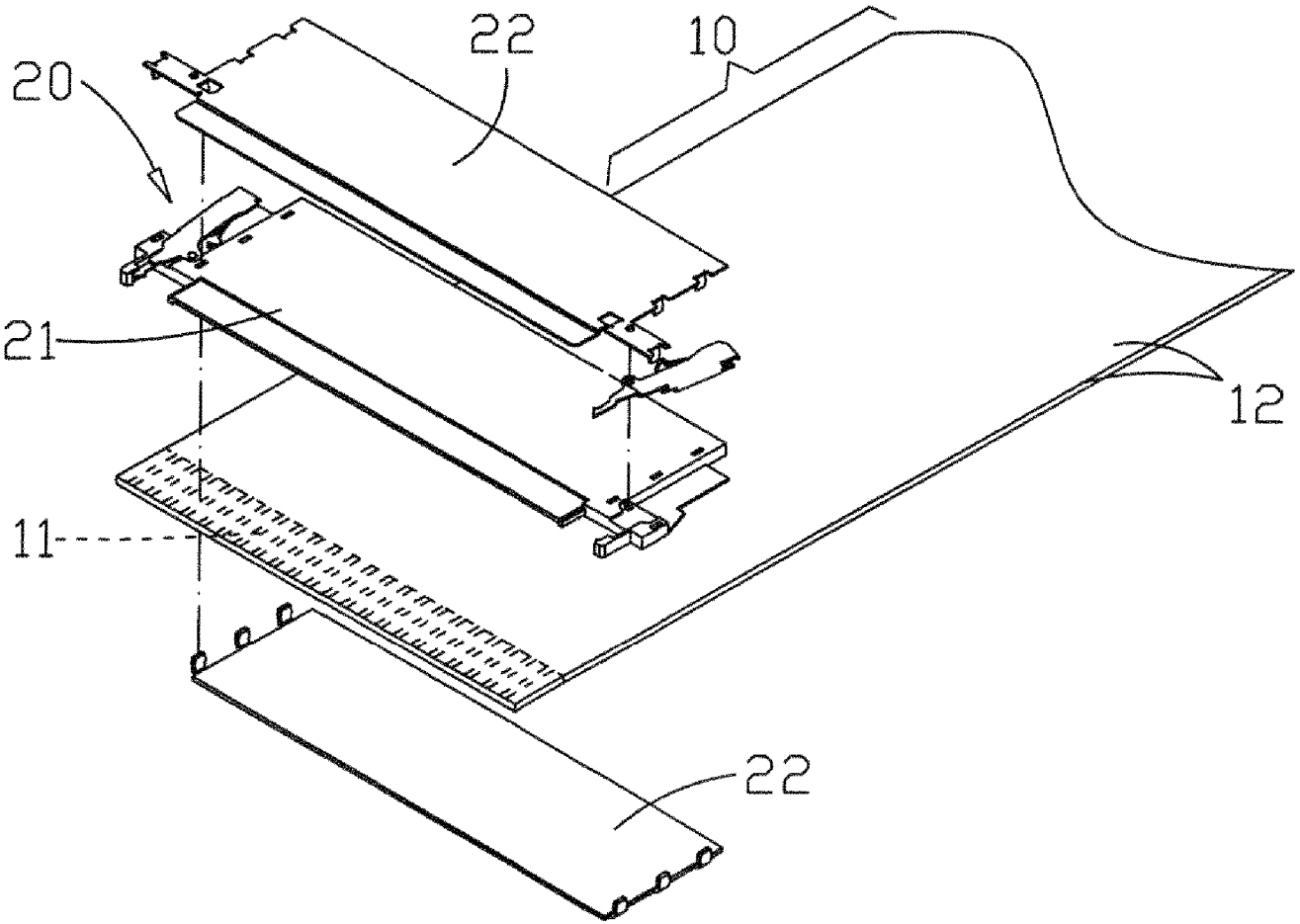
FIG.2 PRIOR ART
FIG. 2 is an exploded view of a connector of a conventional flat cable connection wire assembly.
Figure 3:
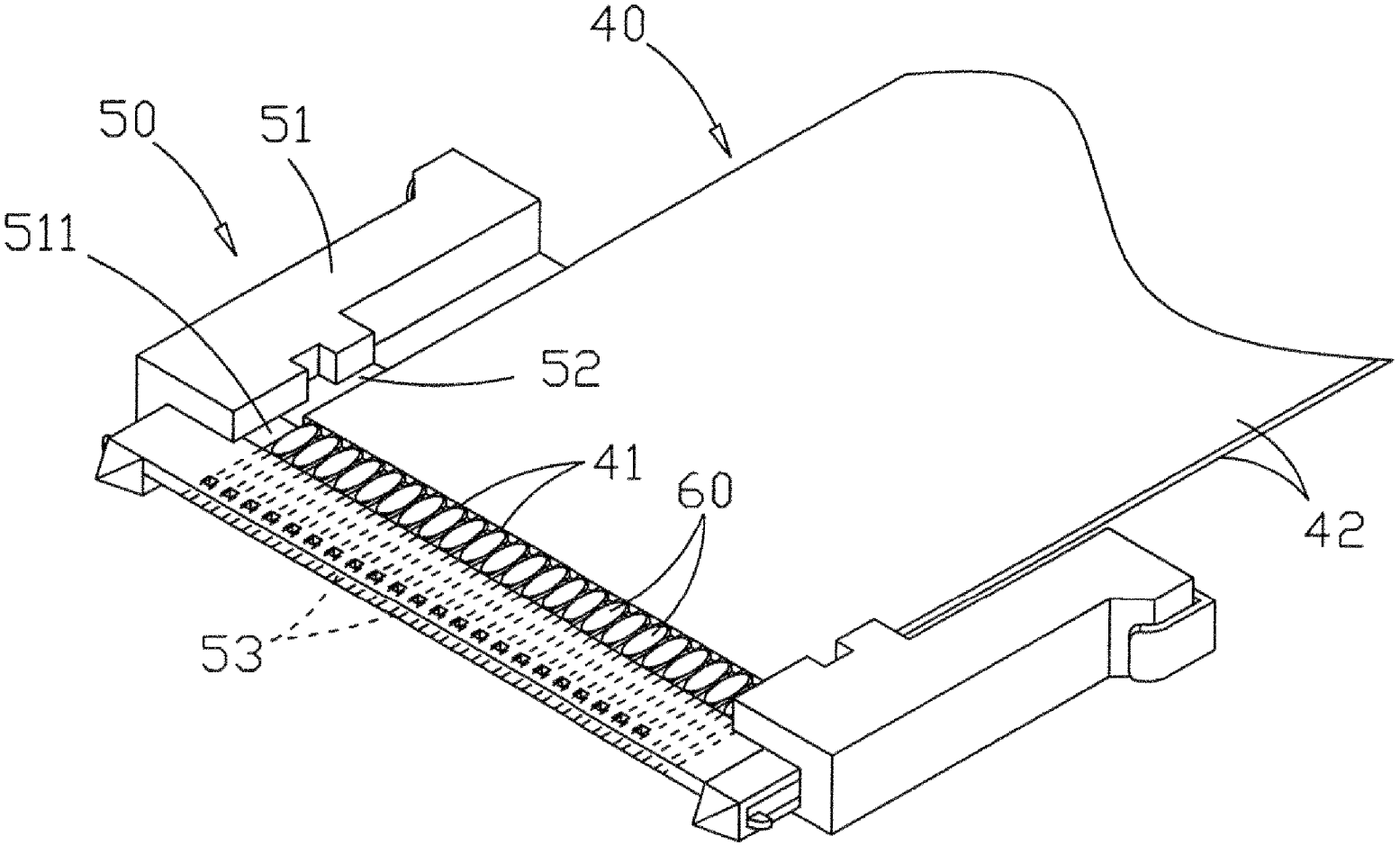
FIG. 3 is a perspective view of a flat cable connection wire assembly in accordance with the present invention.
Figure 4:
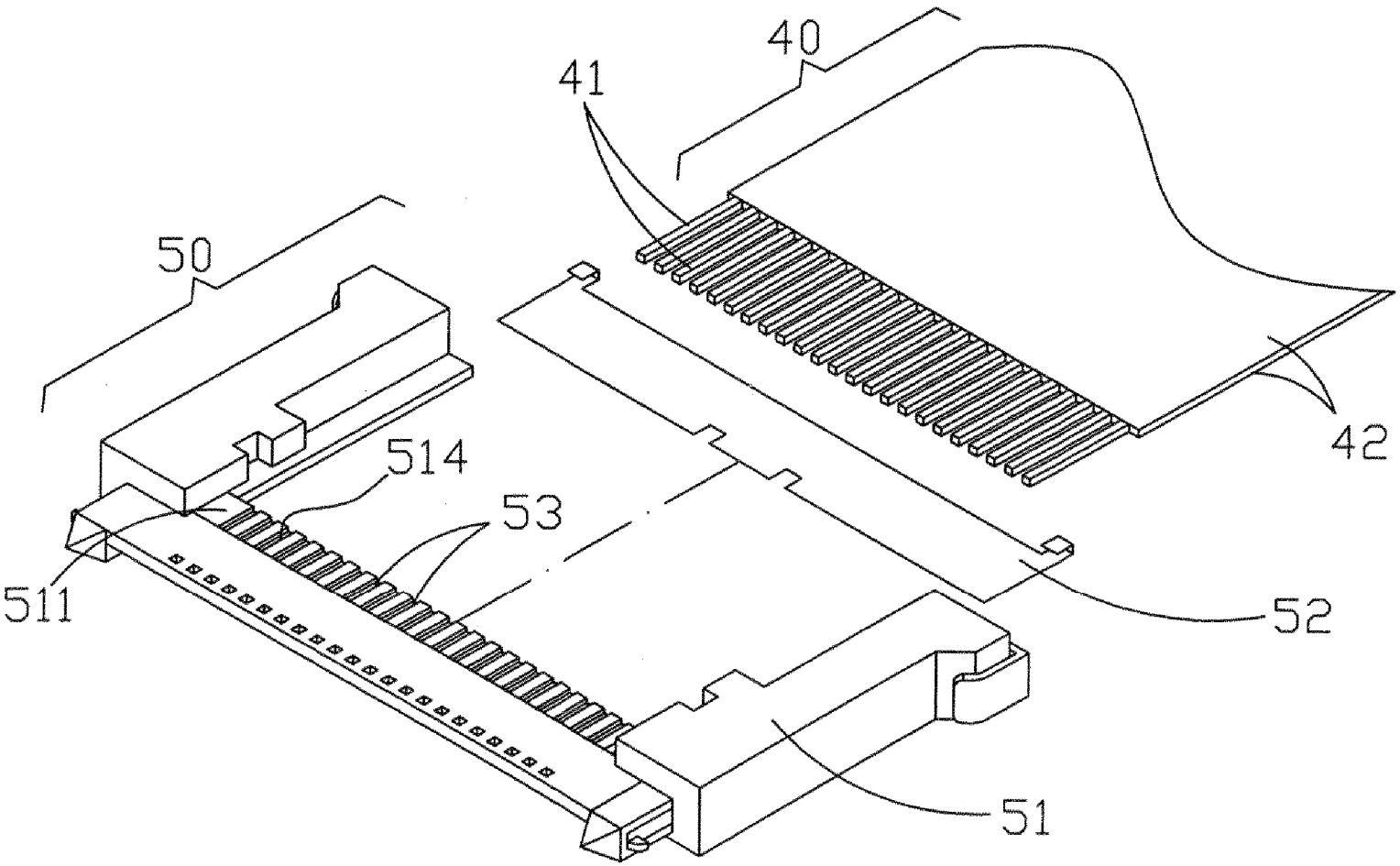
FIG. 4 is an exploded view of a flat cable connection wire assembly in accordance with the present invention.

With reference to FIGS. 3 and 4 for a flat cable connection wire assembly applicable for a signal transmission interface in accordance with the present invention, the signal transmission interface is a low voltage differential signaling (LVDS) interface or a V-by-one interface and a DisplayPort interface, and the assembly includes a flexible flat cable (FFC) 40 and a connector 50 to constitute a connection wire assembly for connecting a transmission port of a main board.

The flexible flat cable 40 includes a plurality of core wires 41, a rubber envelop 42 disposed individually at upper and lower positions of all core wires 41 for fixing the core wires 41. The connector 50 includes a plastic body 51 for separating and arranging all core wires 41, a plurality of terminals 53 for providing an electric connection, and at least one metal casing 52 for supporting the flexible flat cable 40, wherein the metal casing 52 can be installed at the top or the bottom of the flexible flat cable 40.

Figure 5:
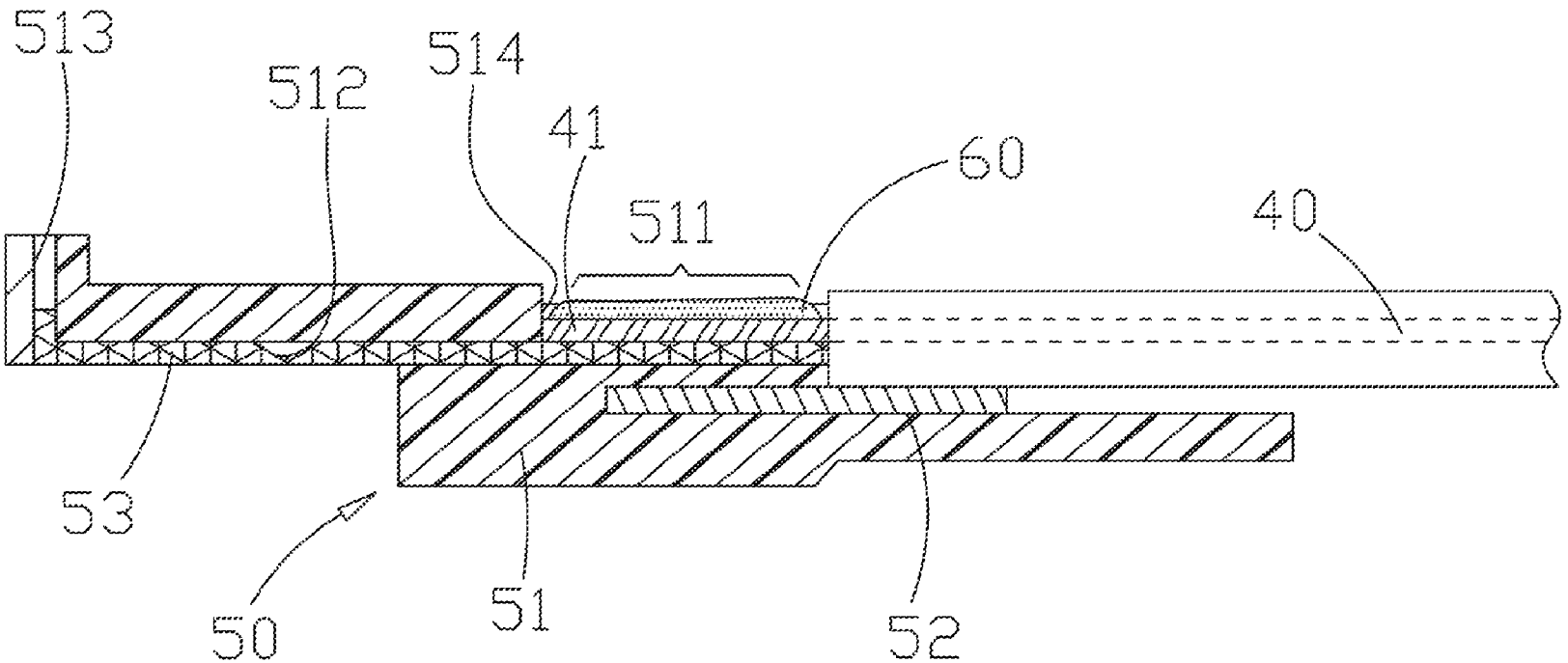
FIG. 5 is a cross-sectional view of a flat cable connection wire assembly in accordance with the present invention.
Figure 6:
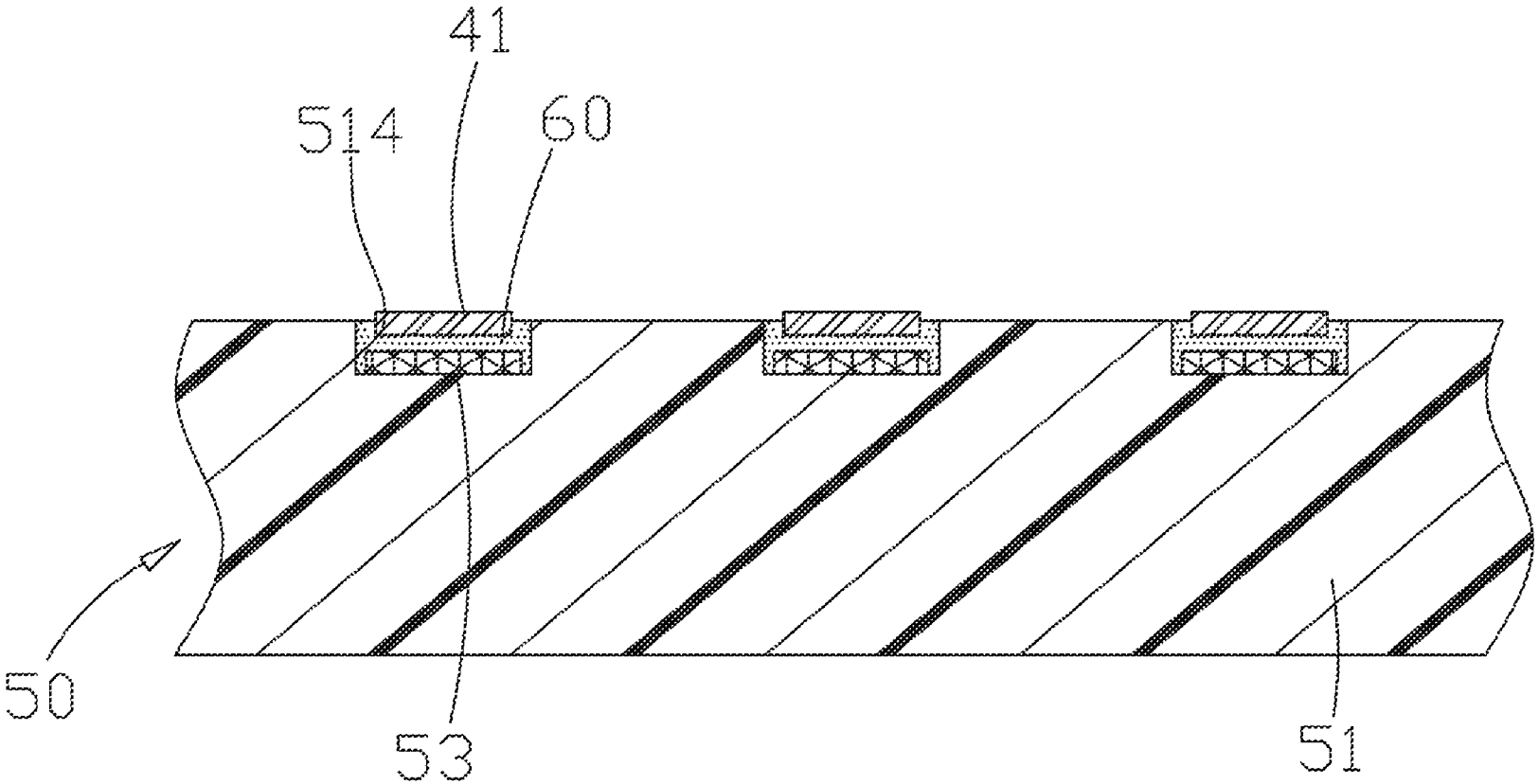
FIG. 6 is another cross-sectional view of a flat cable connection wire assembly in accordance with the present invention.

With reference to FIGS. 5 and 6, the plastic body 51 of the connector 50 has an open section 511 disposed at an end corresponding to the flexible flat cable 40 and provided for inserting and exposing each terminal 53, and a plurality of slots 514 disposed at the open section for positioning each terminal 53. There is a specific interval between the slots 514, such that a specific interval exists between the terminals 53. When the flexible flat cable 40 and the connector 50 are assembled as shown in FIGS. 3 and 5, a soldering 60 is performed for each core wire 41 to fix each terminal 53 in the slot 514 and connect the connector 50.

In addition, each core wire 41 exposed from the rubber envelop 42 of the flexible flat cable 40 has a length greater than the length of each terminal 53 in the slot 514 and a width smaller than the width of the slot 514, and the width of the core wire 41 is smaller than the width of each terminal 53.

In the preferred embodiments, the plastic body 51 includes a plurality of through holes 512 for passing the terminals 53 respectively, and a plurality of fixing holes 513 disposed at another end of the flexible flat cable 40 for inserting ends of the terminals 53 respectively in order to prevent the end of each terminal 53 from being lifted up or projected out.

The flat cable connection wire assembly applicable for a signal transmission interface in accordance with the present invention can fix each core wire of the flat cable to each core wire of the connector by soldering. Such arrangement not only simplifies the structure of the connector significantly, but also enhances the overall quality and reliability of the flat cable connection wire assembly substantially.

In summation of the description, the present invention provides a better feasible flat cable connection wire assembly applicable for a signal transmission interface and complies with the patent application requirements, and thus is filed for patent application. While the invention has been described by means of specific embodiments, numerous modifications and variations could be made thereto by those skilled in the art without departing from the scope and spirit of the invention set forth in the claims.

I claim:

1. A flat cable connection wire assembly applicable for a signal transmission interface, comprising:

a flexible flat cable (FFC), including a plurality of core wires;

at least one connector, including a plastic body and a plurality of terminals provided for an electric connection, and the plastic body including an open section disposed at a position corresponding to an end of the flexible flat cable for inserting and exposing each terminal, and a plurality of slots disposed at the open section for positioning the terminals respectively, and a predetermined interval being maintained between the slots, such that a predetermined interval is maintained between the terminals for soldering each core wire with solder, and provided for soldering the terminals into the slots respectively and coupling with the connector;

wherein, each core wire exposed from a rubber envelop of the flexible flat cable has a length greater than the length of each terminal in each slot, and a width smaller than the width of each slot, and the core wire has a width smaller than the width of each terminal so that the solder contacts both sides of each core wire and both sides of each terminal, wherein the plastic body includes at least one metal casing disposed at a position corresponding to the top or the bottom of the flexible flat cable for supporting the flexible flat cable.

2. The flat cable connection wire assembly applicable for a signal transmission interface as recited in claim 1, wherein the flexible flat cable includes a rubber envelop disposed individually at upper and lower positions of all of the core wires for fixing all of the core wires.

3. The flat cable connection wire assembly applicable for a signal transmission interface as recited in claim 1, wherein the plastic body includes a plurality of through holes for passing the terminals respectively.

4. The flat cable connection wire assembly applicable for a signal transmission interface as recited in claim 1, wherein the plastic body includes a plurality of through holes for passing the terminals respectively, and a plurality of fixing holes disposed at positions corresponding to another end of the flexible flat cable for inserting rear ends of the terminals respectively.

5. The flat cable connection wire assembly applicable for a signal transmission interface as recited in claim 1, wherein the signal transmission interface is a low voltage differential signaling (LVD) interface.

6. The flat cable connection wire assembly applicable for a signal transmission interface as recited in claim 5, wherein the flexible flat cable includes a rubber envelop disposed individually at upper and lower positions of all of the core wires for fixing all of the core wires.

7. The flat cable connection wire assembly applicable for a signal transmission interface as recited in claim 5, wherein the plastic body includes a plurality of through holes for passing the terminals respectively.

8. The flat cable connection wire assembly applicable for a signal transmission interface as recited in claim 5, wherein the plastic body includes a plurality of through holes for passing the terminals respectively, and a plurality of fixing holes disposed at positions corresponding to another end of the flexible flat cable for inserting rear ends of the terminals respectively.

9. The flat cable connection wire assembly applicable for a signal transmission interface as recited in claim 1, wherein the signal transmission interface is a V-by-one interface.

10. The flat cable connection wire assembly applicable for a signal transmission interface as recited in claim 9, wherein the flexible flat cable includes a rubber envelop disposed individually at upper and lower positions of all of the core wires for fixing all of the core wires.

11. The flat cable connection wire assembly applicable for a signal transmission interface as recited in claim 9, wherein the plastic body includes a plurality of through holes for passing the terminal respectively.

12. The flat cable connection wire assembly applicable for a signal transmission interface as recited in claim 9, wherein the plastic body includes a plurality of through holes for passing the terminals respectively, and a plurality of fixing holes disposed at positions corresponding to another end of the flexible flat cable for inserting rear ends of the terminals respectively.

13. The flat cable connection wire assembly applicable for a signal transmission interface as recited in claim 1, wherein the signal transmission interface is a DisplayPort interface.

14. The flat cable connection wire assembly applicable for a signal transmission interface as recited in claim 13, wherein the flexible flat cable includes a rubber envelop disposed individually at upper and lower positions of all of the core wires for fixing all of the core wires.

15. The flat cable connection wire assembly applicable for a signal transmission interface as recited in claim 13, wherein the plastic body includes a plurality of through holes for passing the terminals respectively.

16. The flat cable connection wire assembly applicable for a signal transmission interface as recited in claim 13, wherein the plastic body includes a plurality of through holes for passing the terminals respectively, and a plurality of fixing holes disposed at positions corresponding to another end of the flexible flat cable for inserting rear ends of the terminals respectively.

17. The flat cable connection wire assembly applicable for a signal transmission interface as recited in claim 1, wherein the metal casing directly contacts the flexible flat cable to support the flexible flat cable in a flat position to enable full engagement between the respective core wires and corresponding terminals.

18. The flat cable connection wire assembly applicable for a signal transmission interface as recited in claim 17, wherein the metal casing extends directly beneath the flexible flat cable.

19. The flat cable connection wire assembly applicable for a signal transmission interface as recited in claim 1, wherein the metal casing extends directly beneath the flexible flat cable.

20. The flat cable connection wire assembly applicable for a signal transmission interface as recited in claim 1, wherein the width of each slot with respect to the width of both each respective terminal and the width of each respective core wire is selected to form a gap, a height of each slot with respect to both a height of each respective terminal and a height of each core wire being selected so that solder further contacts a lower surface of each core wire and an upper surface of each terminal.

* * * * *